US009156577B2

(12) United States Patent
Saito et al.

(10) Patent No.: US 9,156,577 B2
(45) Date of Patent: Oct. 13, 2015

(54) SYNTHETIC RESIN BOTTLE

(71) Applicants: Hiromichi Saito, Tokyo (JP); Tadayoshi Oshino, Tokyo (JP); Tsutomu Asari, Chiba (JP)

(72) Inventors: Hiromichi Saito, Tokyo (JP); Tadayoshi Oshino, Tokyo (JP); Tsutomu Asari, Chiba (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 0 days.

(21) Appl. No.: 13/846,431

(22) Filed: Mar. 18, 2013

(65) Prior Publication Data

US 2013/0240477 A1 Sep. 19, 2013

Related U.S. Application Data

(62) Division of application No. 13/473,376, filed on May 16, 2012, now Pat. No. 8,505,756, which is a division of application No. 13/131,377, filed as application No. PCT/JP2009/069530 on Nov. 18, 2009, now Pat. No. 8,353,415.

(30) Foreign Application Priority Data

| | | |
|---|---|---|
| Nov. 27, 2008 | (JP) | 2008-302002 |
| Apr. 30, 2009 | (JP) | 2009-111633 |
| Aug. 27, 2009 | (JP) | 2009-196789 |

(51) Int. Cl.
*B65D 1/02* (2006.01)
*B65D 79/00* (2006.01)

(52) U.S. Cl.
CPC ..... *B65D 1/0276* (2013.01); *B65D 79/005* (2013.01); *B65D 1/0261* (2013.01); *B65D 2501/0036* (2013.01)

(58) Field of Classification Search
CPC .. B65D 1/0276; B65D 1/0261; B65D 1/0284; B65D 79/005
USPC ..... 215/374, 373, 372, 376, 377; 220/609, 220/608
See application file for complete search history.

(56) References Cited

U.S. PATENT DOCUMENTS

| | | | | |
|---|---|---|---|---|
| 3,979,009 | A * | 9/1976 | Walker | 220/609 |
| 4,037,752 | A | 7/1977 | Dulmaine et al. | |

(Continued)

FOREIGN PATENT DOCUMENTS

| | | |
|---|---|---|
| JP | U-57-199511 | 12/1982 |
| JP | U-03-043410 | 4/1991 |

(Continued)

OTHER PUBLICATIONS

Dec. 22, 2009 International Search Report issued in International Application No. PCT/JP2009/06953.
Dec. 22, 2009 Written Opinion of the International Searching Authority issued in International Application No. PCT/JP2009/069530.

*Primary Examiner* — Stephen Castellano
(74) *Attorney, Agent, or Firm* — Oliff PLC

(57) ABSTRACT

A biaxially stretched, blow molded synthetic resin bottle with a bottom includes a sunken bottom portion that is capable of drawing upward in a reversible manner, when internal pressure goes down. This sunken bottom portion includes an inner peripheral wall portion standing from near an inner edge of a ground contact portion disposed along a peripheral foot, a central concave portion disposed at a center of the bottom, a reversible wall portion in a flat ring shape, which is reversibly deformable into an upward drawing state and which connects an upper end of the inner peripheral wall to the base of the central concave portion, and a circular rib wall portion disposed at a connection between the reversible wall portion and the upper end of the inner peripheral wall portion so as to perform the function as a peripheral rib.

5 Claims, 18 Drawing Sheets

(56) References Cited

U.S. PATENT DOCUMENTS

| | | | | |
|---|---|---|---|---|
| 4,642,968 | A | 2/1987 | McHenry et al. | |
| 5,503,283 | A * | 4/1996 | Semersky | 215/375 |
| 8,505,756 | B2 * | 8/2013 | Saito et al. | 215/376 |
| 2002/0063105 | A1 | 5/2002 | Darr et al. | |
| 2006/0006133 | A1 * | 1/2006 | Lisch et al. | 215/374 |
| 2006/0138074 | A1 | 6/2006 | Melrose | |
| 2006/0255005 | A1 | 11/2006 | Melrose et al. | |
| 2007/0199915 | A1 | 8/2007 | Denner et al. | |
| 2008/0047964 | A1 | 2/2008 | Denner et al. | |
| 2009/0159556 | A1 | 6/2009 | Patcheak et al. | |

FOREIGN PATENT DOCUMENTS

| | | |
|---|---|---|
| JP | U-05-081009 | 11/1993 |
| JP | A-08-048322 | 2/1996 |
| JP | A-2006-008200 | 1/2006 |
| JP | A-2006-501109 | 1/2006 |
| JP | A-2007-269392 | 10/2007 |
| JP | A-2007-290772 | 11/2007 |
| JP | A-2008-254244 | 10/2008 |

* cited by examiner (a)

(b)

(a)

(b)

(a)

(b)

(c)

(a)

(b)

SYNTHETIC RESIN BOTTLE

This is a Division of application Ser. No. 13/473,376, filed May 16, 2012, now U.S. Pat. No. 8,505,756, which is a Division of application Ser. No. 13/131,377, filed May 26, 2011, now U.S. Pat. No. 8,353,415, which is a National Phase of Application No. PCT/JP2009/069530, filed Nov. 18, 2009, which claims priority to Japanese Patent Application No. 2008-302002 filed Nov. 27, 2008; Japanese Patent Application No. 2009-111633 filed Apr. 30, 2009; and Japanese Patent Application No. 2009-196789 filed Aug. 27, 2009. The disclosure of the prior applications are hereby incorporated by reference herein in their entirety.

TECHNICAL FIELD

This invention relates to a synthetic resin bottle, especially to the one provided with a body having high shape-retainability and with a bottom allowing reduced pressure to be absorbed by the deformation of a bottom plate, which draws upward when the pressure drops inside the bottle.

BACKGROUND ART

Biaxially stretched and blow-molded bottles made of polyethylene terephthalate (hereinafter referred to as "PET"), the so-called PET bottles, have high transparency, mechanical strength, heat resistance, and gas barrier property, and up to now, have been in wide use as the containers for various beverages. Conventionally, what is called hot filling is utilized as a method of filling the PET bottles with contents, e.g., juices, teas, and the like, which require pasteurization. This involves filling the bottle with the contents at a temperature of about 90 degrees C., sealing the bottle with a cap, and cooling the bottle. This process causes the pressure inside the bottle to decrease considerably.

As regards the application of use involving hot filling described above, Patent Document D1, for example, teaches that the body is provided with the so-called vacuum absorbing panels, which are, by design, easily deformed into a dented state under a reduced pressure condition. At the time of a decrease in pressure, these vacuum absorbing panels perform a vacuum absorbing function by deforming into the dented state, thus allowing the bottle to retain good appearance while ensuring that the portions of the bottle other than the vacuum absorbing panels have rigidity enough to avoid troubles on the bottle conveyor lines, during storage in piles, and inside the automatic vending machines.

On the other hand, in some cases it is necessary to avoid forming the vacuum absorbing panels on the body out of regard for the design of bottle appearance, or it is necessary for body walls to have high surface rigidity to give the body high retainability of shape enough to be able to stack the bottles on their sides inside the vending machines. For example, Patent Document D2 shows a synthetic resin bottle which has no vacuum absorbing panel in the body wall, but in which the vacuum absorbing function is performed by the upward drawing deformation of a bottom plate. Especially in the cases of small-size bottles with a capacity of 350 ml or 280 ml, the vacuum absorbing panels disposed in the body wall would have a limited panel area. In that case, it would be difficult to fully satisfy both of the vacuum-absorbing function and the rigidity or buckling strength of the body. Therefore, the vacuum-absorbing function need be performed by the deformation of bottom plate as described above.

As an example, FIG. 18 shows a bottle 101 in which the vacuum absorbing function is performed by a bottom plate of a bottom 105, which plate deforms so as to draw upward. FIG. 18(*a*) is a front view; and FIG. 18(*b*) is a bottom view. The bottle 101 comprises a body 104 having a thick wall and peripheral groove ribs 107 to give the body 104 high surface rigidity and high buckling strength. When there is a pressure drop inside the bottle, the body 104 retains its shape, but a sunken bottom portion 117 of the bottom 105 performs the vacuum absorbing function when this sunken bottom portion 117 deforms so as to draw further upward (i.e., deformation in an arrowed direction in FIG. 18(*a*)).

PRIOR ART REFERENCES

Patent Documents

Patent Document D1: JP Application No. 1996-048322
Patent Document D2: JP Application No. 2007-269392

SUMMARY OF THE INVENTION

Problems to be Solved by the Invention

However, thin-walled bottles are in large demand in view of material saving and cost reduction, even in the case of the bottle 101 of the type shown in FIG. 18. If a growing trend toward thin-walled bottles continues, a problem arises with the progress of further upward drawing deformation of the sunken bottom portion 117 at the time of a decrease in pressure. This is because the deformation of this sunken bottom portion 117 would not propagate uniformly from the center to the circumference. Instead, as shown in the bottom view of FIG. 18(*b*), several foldlines V are formed in the radial and circumferential directions, and the deformation would go on irregularly in a rugged formation. Eventually, the foldlines V would reach peripheral foot 112 that performs a function as a ground contact portion on the periphery of the bottom 105. If this happens, the bottle 101 would have a bad appearance and lose its self-standing capability.

Once the above-described foldlines V have been formed, the sunken bottom portion 117 would not be fully restored from the state of upward drawing deformation because the foldlines V remain irreversible even after the cap has been opened to eliminate the reduced pressure. As a result, the liquid level of the contents fails to go down sufficiently. If the user screws off the cap of such a bottle to use the contents, the liquid may spill out.

A technical problem to be solved by this invention is to create a bottom plate structure that enables the bottom to perform a satisfactory vacuum absorbing function when the bottom plate draws upward in a manner fully capable of restoring to its original state, to effectively prevent foldlines from extending to the peripheral foot, and to secure the self-standing capability for the bottle, even if the foldlines have to develop from the upward drawing deformation of the bottom plate.

Means of Solving the Problem

A main feature of this invention, among the means of solving the above-described technical problem, is a biaxially stretched, blow molded synthetic resin bottle with a bottom comprising a sunken bottom portion, which is formed by contouring and concaving a bottom plate upward in a direction of bottle inside, starting from an inner peripheral edge of a ground contact portion disposed along peripheral foot, the sunken bottom portion being capable of drawing upward in a reversible manner, when internal pressure goes down, wherein this sunken bottom portion comprises an inner peripheral wall portion standing from near the inner peripheral edge of the ground contact portion disposed along the peripheral foot, a central concave portion disposed at a center of the bottom, a reversible wall portion in a flat ring shape, which is reversibly deformable into an upward drawing state and which connects an upper end of the inner peripheral wall portion to the base of the central concave portion, and a circular rib wall portion disposed at the connection between the reversible wall portion and the upper end of the inner peripheral wall portion so as to perform the function as a peripheral rib.

The bottle having the above-described feature is intended to perform the vacuum-absorbing function by the deformation of the bottom plate which gets dented and draws upward. When pressure decreases inside the bottle, the reversible wall portion turns over so that the central concave portion further draws upward to absorb vacuum.

In the case of conventional bottles of this type, the upward drawing deformation of the sunken bottom portion does not uniformly proceed along the entire circumference, but rather proceeds unevenly, thus forming a bumpy surface and several foldlines. Because of these foldlines, the bottom plate faces the trouble that it cannot return back to their original shape even if the reduced pressure has been eliminated by unscrewing the cap.

Thus, in the above-described main feature, the circular rib wall portion, which serves as a peripheral rib, is disposed at the connection between the upper end of the inner peripheral wall portion and the reversible wall portion. The circular rib wall portion at such a position prevents the above-described foldlines from extending toward the peripheral foot. When the reduced pressure condition is eliminated, the sunken bottom portion can be restored back to its original shape from the upward drawing state by a resilient restoring action of this circular rib wall portion, while erasing the foldlines that have developed in the reversible wall portion during the time of a decrease in pressure. So a basic technical idea of the first main feature is that the circular rib wall portion acting as a peripheral rib is disposed at a position next to the inner peripheral wall portion on the inner side of the peripheral foot of the bottom, to prevent foldlines from extending to the peripheral foot when these foldlines develop in the reversible wall portion during the upward drawing deformation of the sunken bottom portion.

Although basically disposed at the connection between the reversible wall portion and the upper end of the inner peripheral wall portion, the circular rib wall portion can be formed in various embodiments. For example, it may be a flat ring shape, a peripheral groove, or peripheral steps.

Another feature of this invention is that in the first main feature, multiple radial ribs are formed in the radial direction from the central concave portion toward the peripheral foot.

When foldlines are formed by an uneven turn of the reversible wall portion into a dented shape at the time when there is a decrease in pressure, the number and positions of the foldlines are not constant due to a variation in bottom plate thickness, the velocity of pressure reduction, and the like, but they differ depending on individual bottles or individual ways of using the bottles. The above-described feature determines a certain number and positions of the foldlines to be formed. For example, if three radial ribs are disposed at an equal central angle, then the foldlines formed in the reversible wall portion especially in the radial direction can be specified to three foldlines formed over an area ranging from the tips of these radial ribs to the circular rib wall portion. Therefore, a certain level of the vacuum absorbing function can be fulfilled by a certain degree of upward drawing deformation, regardless of individual bottles.

Still another feature of this invention is that in the above-described main feature, the bottle of this invention has a round shape and is provided with multiple peripheral groove ribs in the wall of a cylindrical body.

Because of the feature of multiple peripheral ribs around the cylindrical body, high surface rigidity thus obtained would give the body a high shape-retaining property. It is also possible to provide a round bottle that has the bottom performing the vacuum absorbing function at the time of a decrease in pressure, without forming the vacuum absorbing panels on the body.

A second main feature of this invention, among the means of solving the above-described technical problem, is a biaxially stretched, blow molded synthetic resin bottle comprising a bottom ridge disposed inward from the peripheral foot and formed by projecting a portion of bottom plate downward to a position lower than a level of the peripheral foot so that the bottom ridge performs the function as a ground contact portion, and a central concave portion formed by concaving the bottom plate upward and inward, starting from an edge of an inner sidewall of the bottom ridge, wherein the bottom plate ranging from the bottom ridge to the concave portion performs the vacuum-absorbing function as the bottom plate in this range draws upward during progress of internal depressurization, and wherein in this state, the peripheral foot instead of the bottom ridge is assigned to perform the function as the ground contact portion.

The basic technical idea of the second main feature is to inhibit the progress of foldlines toward the peripheral foot, as is the case in the first main feature, when the foldlines are formed by the upward drawing deformation of the bottom plate. In this embodiment, the bottom ridge disposed between the peripheral foot and the central concave portion performs the function similar to the circular rib wall portion in the first main feature. An additional aspect of this second main feature is that the bottom ridge projects downward to a position lower than the level of the peripheral foot. And when there is a decrease in pressure inside the bottle, the portion of the bottom plate ranging from this bottom ridge to the central concave portion (sometimes also referred to as an deformable sunken portion) performs the vacuum-absorbing function by drawing upward and further concaving toward the inside of the bottle.

Before the deformable sunken portion draws upward due to the reduction in internal pressure, the bottom ridge would function as the ground contact portion. Then, with the decrease in internal pressure, the deformable sunken portion draws upward, and the projecting bottom ridge retreats toward the inside of the bottom so that the lowermost portion of the bottom ridge moves up to a position higher than the level of the peripheral foot. In this state, the peripheral foot functions as the ground contact portion. Thus, the function of the ground contact portion is shared by the bottom ridge and the peripheral foot. The bottom ridge can fully move up without damaging the self-standing property of the bottle at the time of a decrease in pressure.

The bottom ridge is formed by projecting the bottom plate downward in a flexing manner. At the time of a decrease in pressure, the flexed bottom plate extends so that the deformable sunken portion draws upward to a large extent. Along with the feature of the above-described bottom ridge that fully draws upward, the vacuum-absorbing function of the bottom can be performed satisfactorily. Because the vacuum-absorbing function is performed easily, foldlines are prevented from developing in the deformable sunken portion. In addition, the bottom ridge serving as a rib is also effective to prevent the foldlines from developing at the peripheral foot.

Another feature of this invention is that in the second main feature, the peripheral foot disposed in the bottom portion is at first formed to have a flat portion. After the deformable sunken portion has drawn upward under a reduced pressure condition, with the projecting bottom ridge having moved up to a higher position than the level of the peripheral foot, the flat portion helps the peripheral foot to perform the ground contact function steadily. The peripheral foot characterized by a flat portion indicates that before the deformation, the flat portion is perpendicular to the central axial direction of the bottle and has a horizontal plane at the bottle standing position.

Still another feature of this invention is that in the second main feature, the peripheral foot surrounding the bottom has a circular flat foot portion. When the deformable sunken portion draws upward under the reduced pressure condition, and the projecting bottom ridge moves up, and its ground contact surface takes a position higher than the level of the peripheral foot, the circular flat foot portion helps the peripheral foot to perform the function as a ground contact portion. The flat foot portion is not only circular, but also it can be polygonal close to a circle. The circular flat foot portion in this feature is perpendicular to the central axial direction of the bottle and has a horizontal plane at the bottle standing position.

Still another feature of this invention is that in the second main feature describe above, the peripheral foot has a surface sloped obliquely upward in the central axial direction of the bottle.

In a hot filling process, right after the bottle has been filled with hot contents and sealed with a cap, sometimes the synthetic resin of the bottle may get soft, while the bottle is in an internally pressurized state. At such a time, a problem arises in that the bottom plate of the bottle swells downward, and a so-called bottom-sinking phenomenon takes place. The bottle having the above-described feature has been designed, bearing in mind that the bottle can effectively control this phenomenon. Because the peripheral foot having this feature is provided with a surface sloped obliquely upward in the central axial direction of the bottle, the bottle can effectively control the above-described bottom-sinking phenomenon from occurring. Later when the pressure decreases inside the bottle, the deformable sunken portion is allowed to draw upward uniformly and to perform the vacuum-absorbing function smoothly. The peripheral foot retains fully the self-standing capability for the bottle.

Still another feature of this invention is that in the above feature, the peripheral foot has a width in a range of 2 to 4 mm and a difference in height in a range of 0.2 to 0.8 mm between a lowermost end and an inner edge, respectively, of the peripheral foot.

The horizontally-kept inside portion of the peripheral foot tends to cause the bottom to sink to a large extent. If the bottom sinking increases to some large extent, then the deformable sunken portion draws upward in an unbalanced manner when there is a decrease in pressure inside the bottle. Especially this occurs in those cases where the bottle is filled with contents at a higher temperature than usual, or where bottle wall thinning is expected to go on in this field. As a result, the vacuum-absorbing function is not performed adequately. There might be a possibility that the self-standing capability of the bottle is damaged. On the other hand, if the peripheral foot has too sharp a slope, bottom sinking cannot be controlled satisfactorily. In that case, it becomes also difficult for the deformable sunken portion to draw upward smoothly, and the vacuum-absorbing function is no longer performed adequately.

It is preferred that the width of the peripheral foot is in a range of 2 to 4 mm, taking into account the function of the peripheral foot as the ground contact portion after the deformable sunken portion has drawn upward at the time of a decrease in pressure inside the bottle. With this width in the range of 2 to 4 mm, the difference in height is set in a range of 0.2 to 0.8 mm, by defining the degree of inclination of the peripheral foot as the difference in height between the lower end and the inner edge of the peripheral foot. With the difference in height within this range, the vacuum-absorbing function can be fully performed while controlling the bottom sinking effectively.

Still another feature of this invention is that in the second main feature, a circular bottom ridge is used as the bottom ridge. The circular bottom ridge ensures that its function as the ground contact portion becomes much steadier. It is to be understood here that the shape of the bottom ridge is not limited to the circular bottom ridge. Multiple bottom ridges may be disposed in a concentric fashion. Apart from a circular bottom ridge or ridges, there may be also a polygonal bottom ridge or ridges.

Still another feature of this invention is that in the second main feature, the central concave portion is disposed on the inner side of the bottom ridge by way of a step.

According to this feature, the step plays a role of a circular rib, and enables the deformable sunken portion to draw upward smoothly at the time of a decrease in internal pressure. The step also contributes to control the development of foldlines effectively in the aforementioned deformable sunken portion.

Still another feature of this invention is that in the second main feature, the bottom ridge has a cross-section of a trapezoidal shape or a U-letter shape. According to this feature, the trapezoidal or U-letter shape of the bottom ridge is allowed to extend so that the deformable sunken portion draws upward smoothly. The bottom ridge is also allowed to perform the ground contacting function by utilizing a lowermost flat ridge portion of the trapezoidal or U-shaped bottom ridge.

If the bottom ridge has a trapezoidal or U-shaped cross-section, the dimensions, such as the width and projecting height of the bottom ridge, can be arbitrarily set, giving consideration to bottle size, wall thickness, and the capability of the bottle to stand alone, and relying on calculations and test results regarding the way of deformation including easiness of bottom plate to deform.

Still another feature of this invention is that in the second main feature, the central concave portion has a shape in which its cross-section changes from a circular shape in and near the central area to a regular triangular shape at the base.

According to this feature, the foldlines that develop can be specified and diverted to directions in which apexes of a regular triangle are positioned in a plane cross-section. Thus, the formation of foldlines in the circular flat foot portion can be controlled effectively. Since the deformation into a dented state can be controlled properly, the bottom is led to perform the vacuum-absorbing function more stably and steadily.

Still another feature of this invention is that in the second main feature, a groove-like recess is disposed on the boundary between an inner circular edge of the peripheral foot and an outer edge of the bottom ridge. This recess is formed by depressing the bottom plate upward and inward in a stepped manner.

According to this feature, the groove-like recess can be used as the starting point to cause the deformable sunken portion to draw upward smoothly. The recess also withholds the peripheral foot from being distorted during the deformation, and helps the peripheral foot perform stably the function as the ground contact portion.

Still another feature of this invention is that in the second main feature, the round body is provided with a plurality of peripheral groove ribs notched in the body wall.

According to this feature, a plurality of peripheral groove ribs on the cylindrical body increases surface rigidity of the body and imparts the bottle with high shape retainability. Thus, a round bottle is provided in which vacuum-absorbing panels are disposed not on the body, but on the bottom to perform the vacuum-absorbing function when there is a decrease in internal pressure.

Effects of the Invention

This invention having above-described features has the following effects:

In the case of bottles having the first main feature, the bottle is intended to perform the vacuum-absorbing function by the deformation of a bottom plate which turns the other way round and draws upward. In such a bottle, the circular rib wall portion of the bottom plate inhibits the progress of foldlines toward the peripheral foot. When the cap is opened, the elastic restoring action of the circular rib wall portion can restore the sunken bottom portion from a higher level to the original state, while eliminating the foldlines that have developed in the reversible wall portion at the time of a decrease in pressure.

In addition, in the case of bottles having multiple radial ribs disposed radially from the central concave portion toward the peripheral foot, the number and positions of foldlines can be made constant. A certain level of the vacuum-absorbing function can be fulfilled by a certain degree of upward drawing deformation, regardless of individual bottles.

In the case of the bottle having the second main feature, the bottom ridge prevents foldlines from extending toward the peripheral foot, and the function of the ground contact portion is shared by the bottom ridge and the peripheral foot. Thus, the bottom ridge can fully move up without damaging the self-standing capability of the bottle at the time of a decrease in pressure.

The bottom ridge is formed by projecting the bottom plate downward in a flexing manner. At the time of a decrease in pressure, the flexed bottom plate extends so that the deformable sunken portion draws upward to a large extent. Along with the feature of the above-described bottom ridge that fully draws upward, the vacuum-absorbing function of the bottom can be fulfilled satisfactorily.

BRIEF DESCRIPTION OF THE DRAWINGS

FIG. 1(*b*) is a bottom view, showing the bottle in the first embodiment of this invention.

FIG. 2(*b*) is a bottom view, showing a change in bottom plate of the bottle of FIG. 1 at the time of a decrease in pressure.

FIG. 4(*b*) is a bottom view, showing the bottle in the second embodiment of this invention.

FIG. 5(*b*) is a bottom view, showing a change in the bottom plate of the bottle of FIG. 4 at the time of a decrease in pressure.

FIG. 6(*b*) is a bottom view, showing a conventional bottle.

FIG. 7(*b*) is a bottom view, showing a change in the bottom plate of the bottle of FIG. 6 at the time of a decrease in pressure.

FIG. 8(*b*) is a bottom view, showing a change in the bottom plate of the conventional bottle from the state shown in FIG. 7, as observed when the cap is opened.

FIG. 16(*b*) is a similar vertical section of the bottle in the fifth embodiment of this invention offered for a comparison.

FIG. 18(*b*) is a bottom view, each showing another conventional bottle.

PREFERRED EMBODIMENTS FOR CARRYING OUT THE INVENTION

Figure 1:
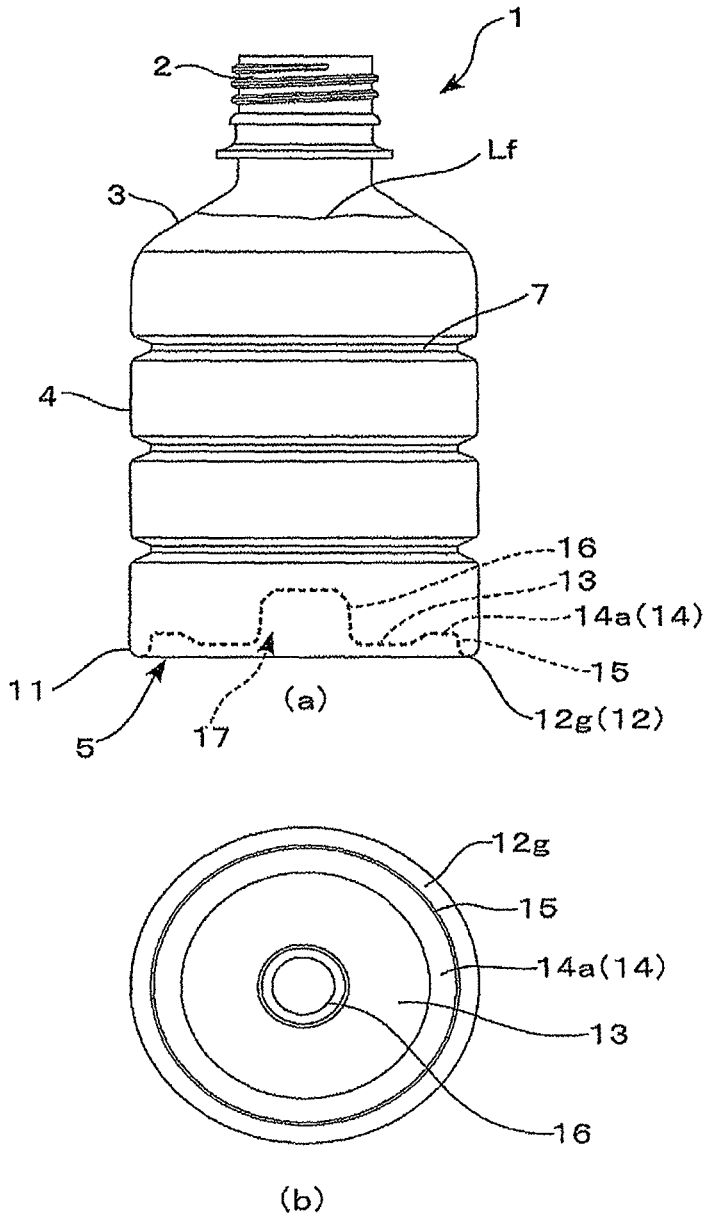
FIG. 1(*a*) is a front view.

This invention is further described with respect to preferred embodiments, now referring to the drawings. FIG. 1(*a*) is a front view; and FIG. 1(*b*) is a bottom view, showing the synthetic resin bottle in the first embodiment of this invention. The bottle 1 comprises a neck 2, a shoulder 3, a cylindrical body 4, and a bottom 5, and is a biaxially stretched, blow-molded product made of a PET resin with a capacity of 350 ml.

The body 4 has three peripheral groove ribs 7, and thus, has high surface rigidity and high shape retainability. The lower end of the body 4 is connected to the bottom 5 by way of a heel wall portion 11 having a curved surface. Peripheral foot 12 is disposed around the bottom 5 and is provided with a ground contact portion 12*g*.

A sunken bottom portion 17 is formed in the bottom 5 by contouring and concaving a bottom plate upward in the direction of inside of the bottle 1, starting from an inner peripheral edge of the ground contact portion 12*g*. When the inside of the bottle 1 falls under a reduced pressure condition, this sunken bottom portion 17 draws upward and toward the bottle inside to perform the vacuum-absorbing function.

In its structure, the sunken bottom portion 17 comprises an inner peripheral wall portion 15, which stands up from near the inner peripheral edge of the ground contact portion 12*g* of the peripheral foot 12, a central concave portion 16 which is in a shape of an dome or in a shape of an inverted cylindrical cup and is concaved in a central part of the bottom 5, and a flat ring-like reversible wall portion 13, which connects the upper end of the inner peripheral wall portion 15 to the base of the central concave portion 16. In addition, a flat ring portion 14*a* is an embodiment of the circular rib wall portion 14 to perform the function as a peripheral rib, and is disposed at the connection between the upper end of the inner peripheral wall portion 15 and the reversible wall portion 13. The reversible wall portion 13 is reversibly deformable toward the inside of the bottle, and is formed in a gradually convexed shape toward the outside of the bottle.

Figure 2:
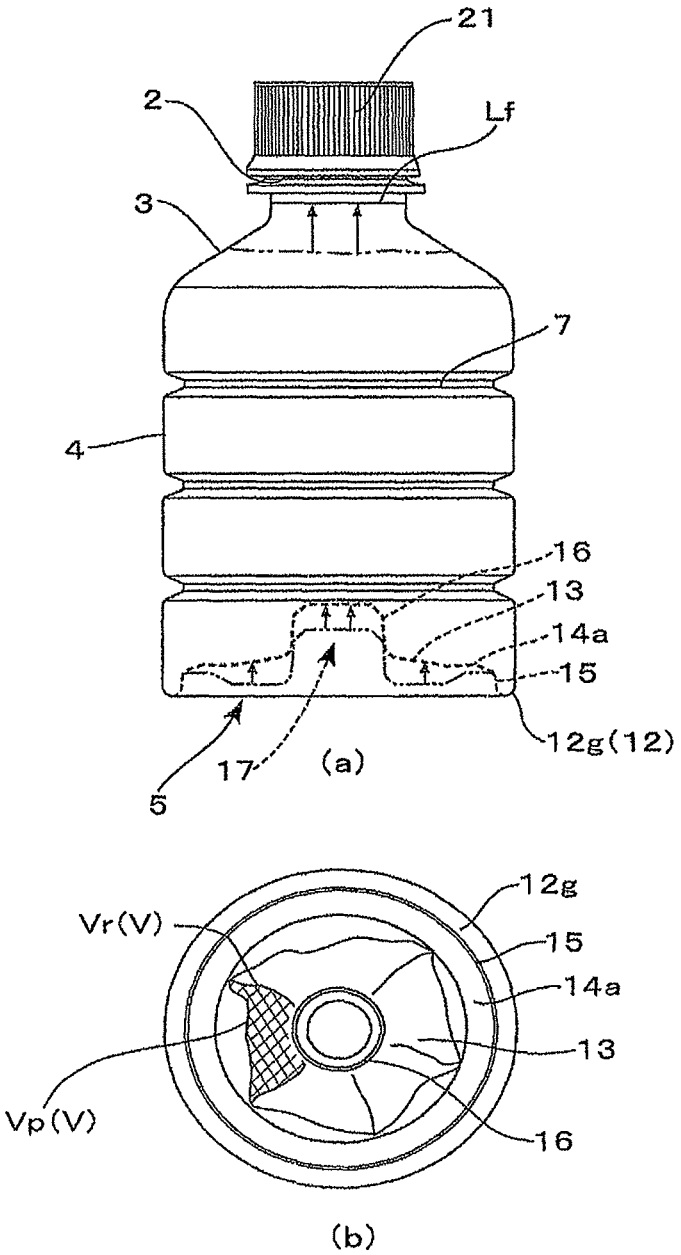
FIG. 2(*a*) is a front view.

FIG. 2(*a*) is a front view, and FIG. 2(*b*) is a bottom view, of the bottle of FIG. 1, showing the movement of the sunken bottom portion 17 drawing upward at the time when the bottle of FIG. 1 has been filled with contents at a high temperature, sealed with a cap 21, and cooled, and then encountered with a reduced pressure condition. The reversible wall portion 13 is reversibly deformed from the original shape of FIG. 1, i.e., the shape shown by a two-dot chain line in FIG. 2(*a*), to a shape shown by a dotted line in FIG. 2(*a*), in the arrowed direction toward the inside of the bottle 1. At that time, with the upward drawing deformation of the sunken bottom portion 17, the liquid level Lf would rise to a height position right beneath the lower end of the neck 2.

The bottom plate of the bottle 1 does not always have a uniform thickness, and since at the time of a decrease in pressure, the upward drawing deformation gradually goes on, the deformation of the reversible wall portion 13 does not go on uniformly along the circumference, but proceeds unevenly while forming several foldlines V. Eventually, the foldlines come to a pattern such as shown in the bottom view of FIG. 2(*b*).

The pattern of foldlines V shown in FIG. 2(*b*) is merely an example. Depending on individual bottles or the rate of progress of depressurization, a different pattern may appear, but the pattern has the following common characteristics: Firstly, several foldlines Vr (five in this embodiment) develop in the radial direction, and extend toward the inner peripheral edge of the flat ring portion 14*a*, which performs the function as a circular rib. Secondly, foldlines Vp develop in the circumferential direction so as to connect between two adjacent points at which the radial foldlines Vr abut on the inner edge of the flat ring portion 14*a*. The area inside of a circumferential foldline Vp and sandwiched between two adjacent radial foldlines Vr (for example, a cross-hatched area in FIG. 2(*b*)) correspond to an area where the inward drawing deformation of the reversible wall portion 13 has made much progress.

When the cap 21 is opened, and the inside of the bottle 1 returns to normal pressure from a reduced pressure condition shown in FIG. 2, the foldlines V become flat and disappear due to the action and effect of the flat ring portion 14*a* serving as the circular rib, i.e., its elastically restoring action. As a result, the reversible wall portion 13 turns the other way round, the sunken bottom portion 17 restores its original shape shown in FIG. 1(*a*), and the liquid level Lf goes down.

Figure 3:
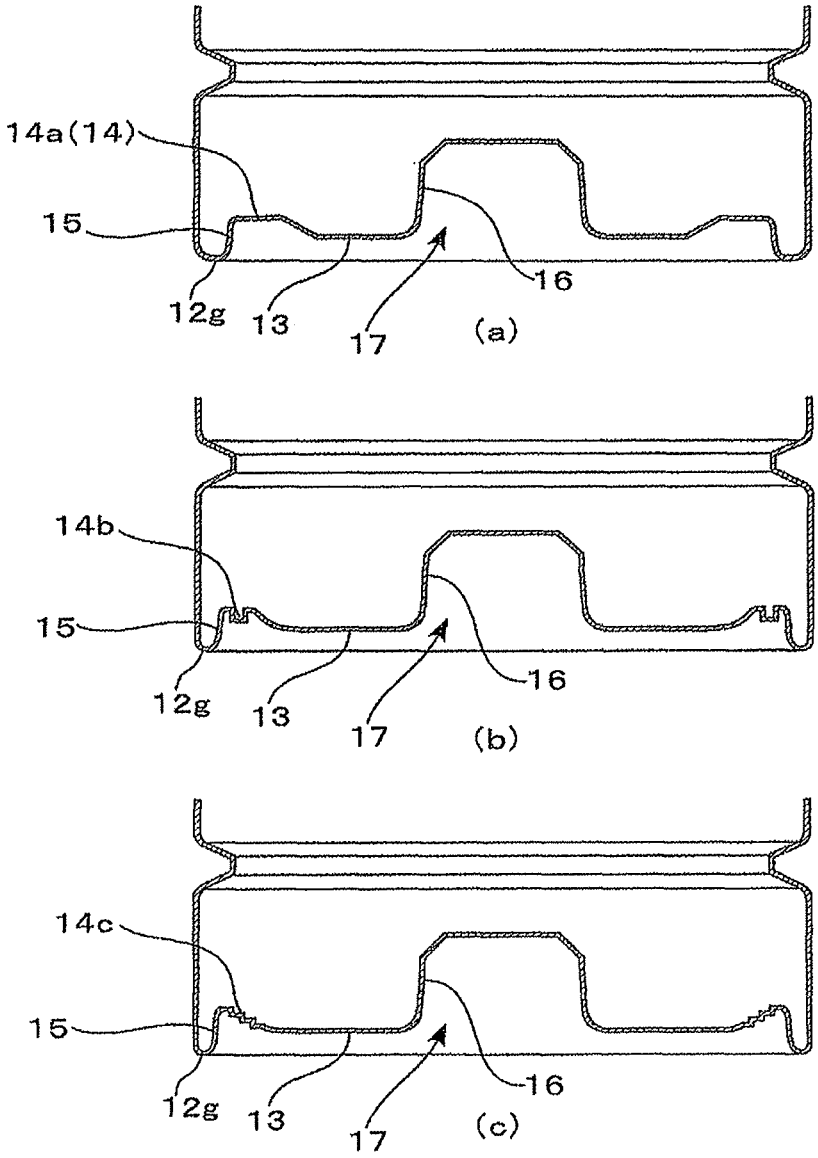
FIGS. 3(*a*), 3(*b*), and 3(*c*) are explanatory diagrams showing variations of the circular rib wall portion.

FIGS. 3(*a*), 3(*b*), and 3(*c*) are enlarged vertical sectional views of bottom 5 and its vicinity, showing variations of circular rib wall portion 14 that performs a peripheral rib function. FIG. 3(*a*) shows a flat ring portion 14*a* similar to that of the bottle 1 in FIG. 1. FIG. 3(*b*) shows a circular groove 14*b*, and FIG. 3(*c*) shows a circular step portion 14*c*. All of them can perform the function of eliminating foldlines V that are formed under a reduced pressure condition.

Figure 4:
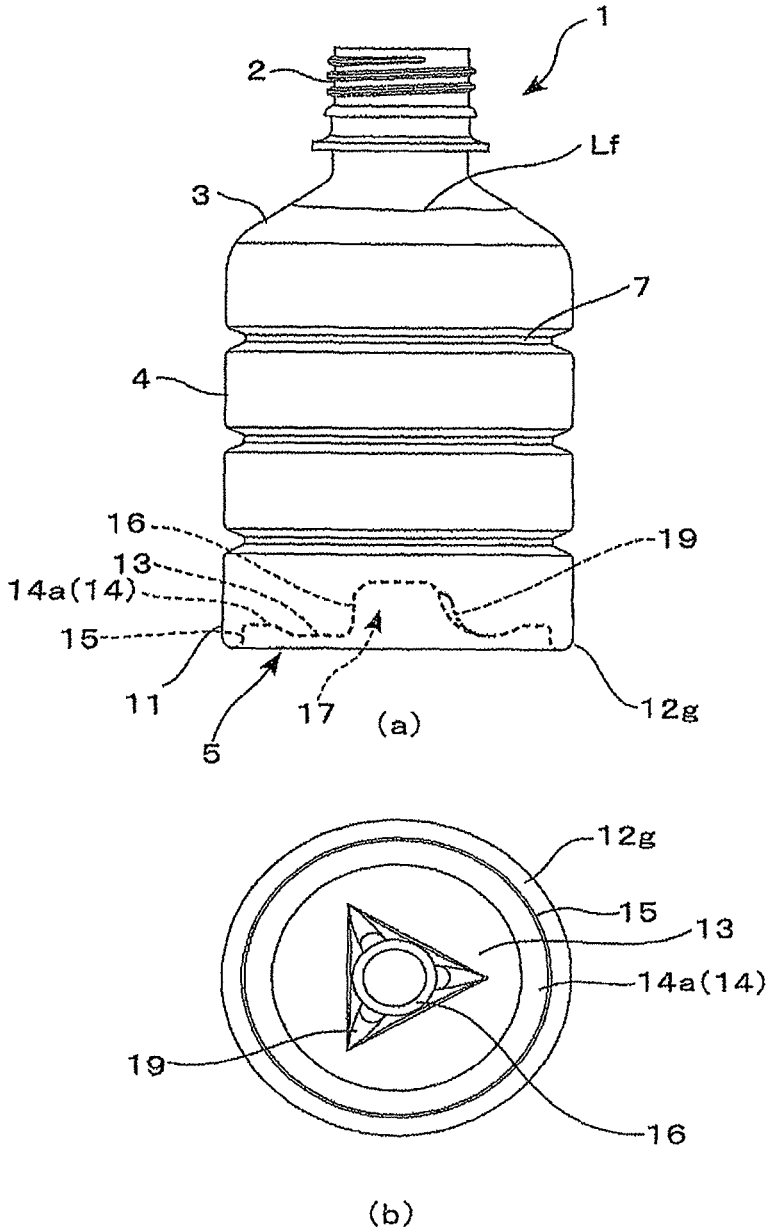
FIG. 4(*a*) is a front view.

FIG. 4 shows the synthetic resin bottle in the second embodiment of this invention. As compared with the bottle of the first embodiment shown in FIG. 1, the bottle in the second embodiment is characterized in that three radial ribs 19 are disposed at positions of an equal central angle so as to extend from the central concave portion 16 toward the peripheral foot. Except for these radial ribs 19, the bottle is similar to the bottle of the first embodiment.

Figure 5:
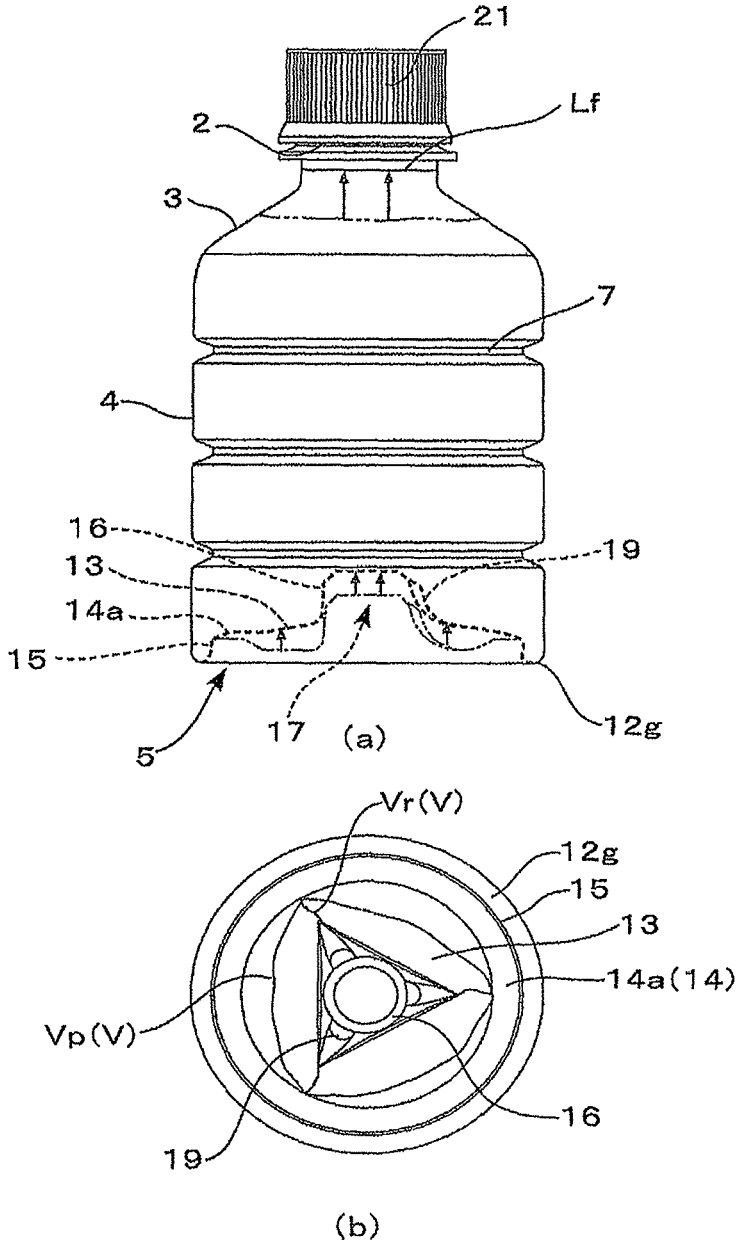
FIG. 5(*a*) is a front view.

FIG. 5(*a*) is a front view, and FIG. 5(*b*) is a bottom view, of the bottle 1 of FIG. 4, showing a change in the sunken bottom portion 17 observed when the bottle is filled with contents at a high temperature, sealed with the cap 21, and cooled, and allowed to fall into the depressurized state. From the shape shown in FIG. 5(*a*) by a two-dot chain line, the sunken bottom portion 17 draws upward in the inward direction of the bottle 1, as shown by arrows, to perform the vacuum-absorbing function.

The bottom view of FIG. 5(*b*) shows the action-and-effect of radial ribs 19 in the second embodiment. The radial ribs 19 thus formed ensure that the foldlines Vr are limited to a specified range in which they extend from the tips of the radial ribs 19 to the inner peripheral edge of the flat ring portion 14*a*. In other words, the numbers and positions of the foldlines Vr and Vp can be made constant, regardless of individual bottles. Therefore, it is possible to obtain a constant capacity of upward drawing deformation and to allow a constant level of vacuum-absorbing function to be performed, regardless of individual bottles.

When the cap 21 is opened, and the inside of the bottle 1 returns to normal pressure from a reduced pressure condition shown in FIG. 5, the foldlines V become flat and disappear due to the action-and-effect of the flat ring portion 14*a* serving as the circular rib, or due to its elastically restoring action. As a result, the reversible wall portion 13 turns the other way round, the sunken bottom portion 17 restores its original shape shown in FIG. 4, and the liquid level Lf goes down.

Figure 6:
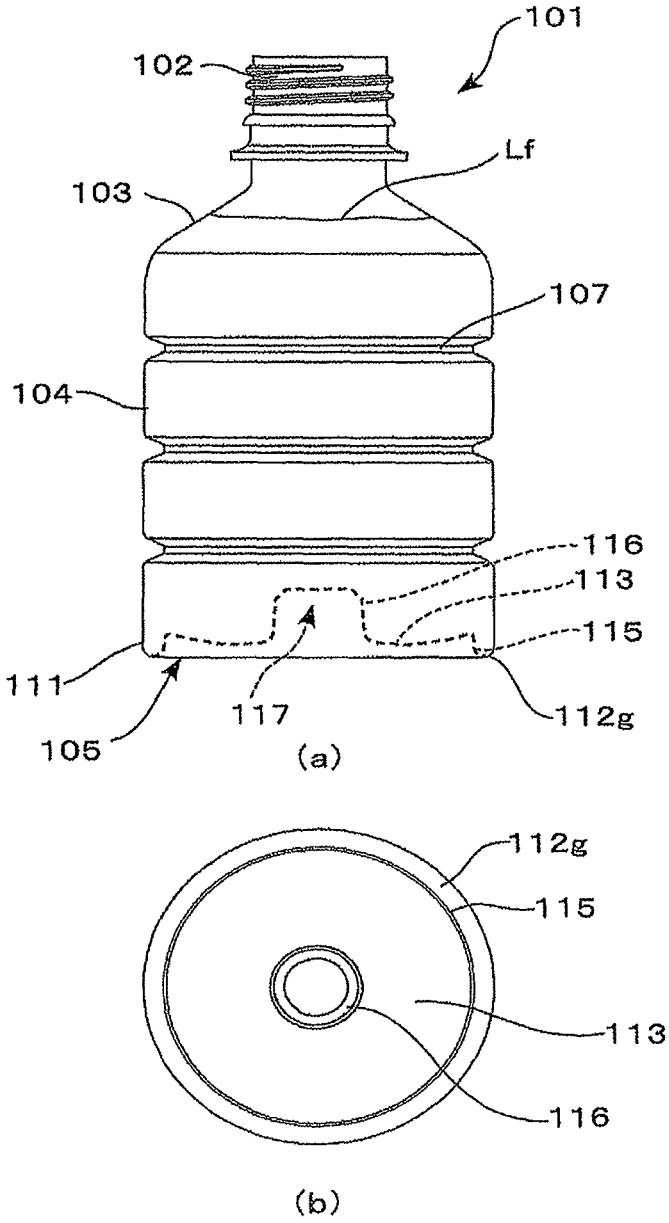
FIG. 6(*a*) is a front view.

FIGS. 6(*a*) and 6(*b*) show a conventional synthetic resin bottle. As compared with the bottle of the first embodiment shown in FIG. 1, the conventional bottle does not have a flat ring portion 14*a* performing as a circular rib at the connection between the inner peripheral wall portion 115 and the reversible wall portion 113, but the upper end of the inner peripheral wall portion 115 is directly connected to the reversible wall portion 113.

Figure 7:
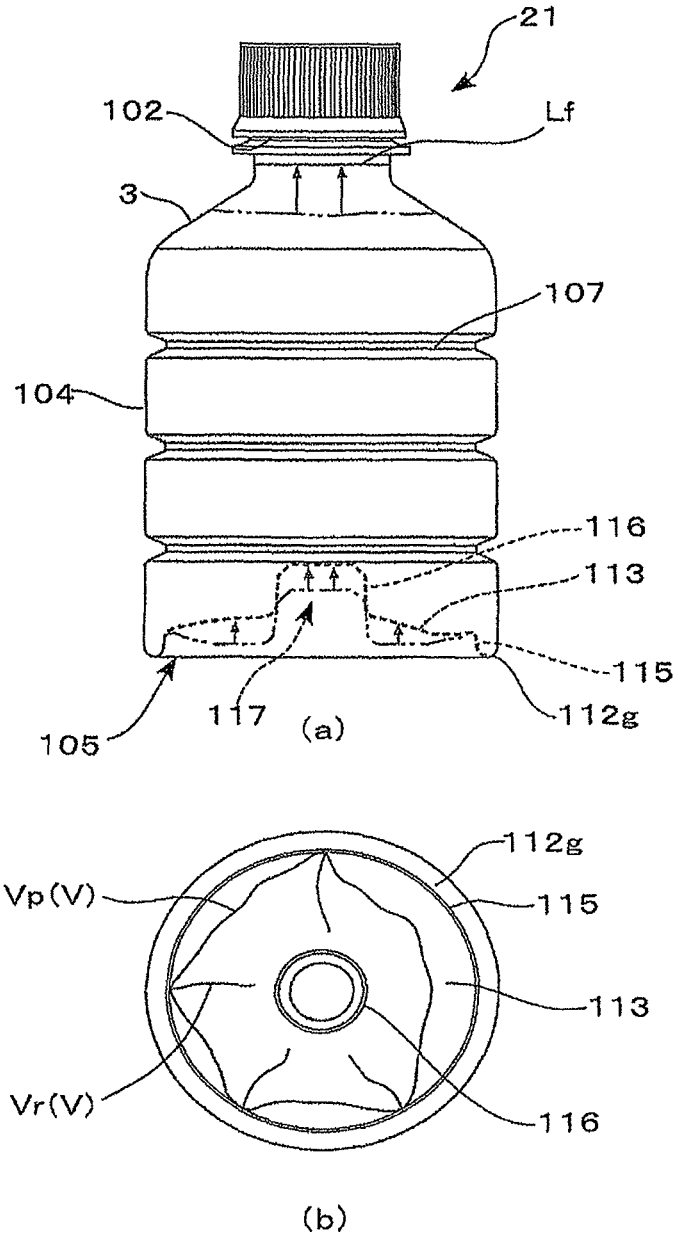
FIG. 7(*a*) is a front view.

FIG. 7(*a*) is a front view, and FIG. 7(*b*) is a bottom view, of the conventional bottle 101 of FIG. 6, showing a change in the sunken bottom portion 117 observed when the bottle is sealed with the cap 21, and allowed to fall into a reduced pressure state. In FIG. 7(*a*), the reversible wall portion 113 deforms from the shape shown in FIG. 7(*a*) by a two-dot chain line, and draws upward in the inward direction of the bottle 101, as shown by arrows, to perform the vacuum-absorbing function. The liquid level Lf goes up along with the upward drawing deformation.

Like in bottle 1, the bottom plate of the conventional bottle 101 does not always have a uniform thickness, and since at the time of a decrease in pressure, the upward drawing deformation gradually goes on, the deformation of the reversible wall portion 113 does not go on uniformly along the circumference, but proceeds unevenly while forming several foldlines V. Eventually, as shown in the bottom view of FIG. 7(*b*), several foldlines Vr (four in this example) develop in the radial direction, and extend toward the upper end of the inner peripheral wall portion 115. In addition, foldlines Vp develop in the circumferential direction so as to connect between two adjacent points at which the radial foldlines Vr abut on the upper end of the inner peripheral wall portion 115.

Figure 8:
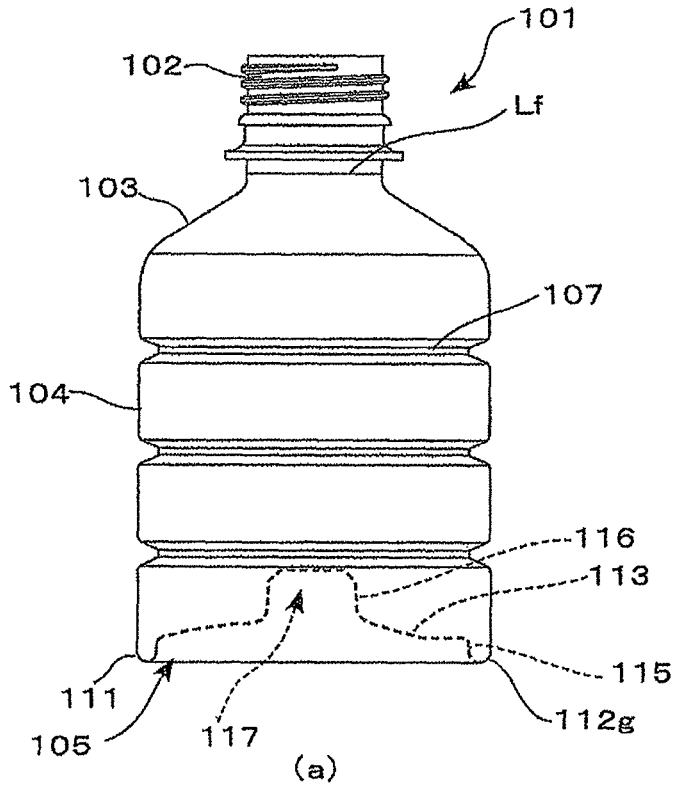
FIG. 8(*a*) is a front view.
Figure 8:
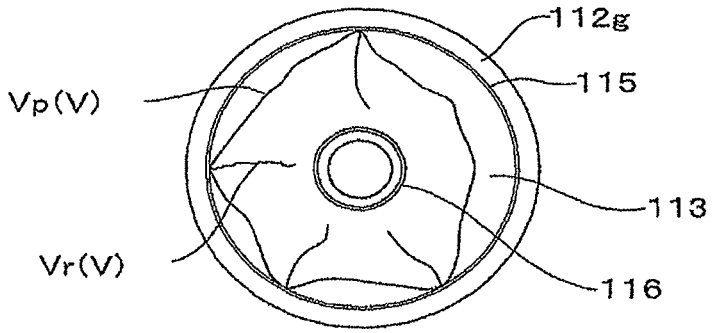

FIG. 8(*a*) is a front view, and FIG. 8(*b*) is a bottom view, of the sunken bottom portion 117, showing an example of a change from the original shape shown in FIG. 7 when the cap 21 has been opened. In this example, the sunken bottom portion 117 has no circular rib wall portion 14, such as the flat ring portion 14*a*, which in the bottle 1 in the first embodiment of this invention, functions as the circular rib and performs its elastically restoring action to enable the foldlines to disappear and return to the flat surface. Therefore, even if the bottle has been opened, the foldlines V remain as they are, and the sunken bottom portion 117 hardly restores to its original shape from the upward drawing shape. Since the liquid level Lf does not go down, a problem arises that the liquid spills out from the bottle. The extent of recovery from the upward drawing state may naturally differ depending on individual bottles, but on the whole, a sufficiently restored state is not observed.

Figure 9:
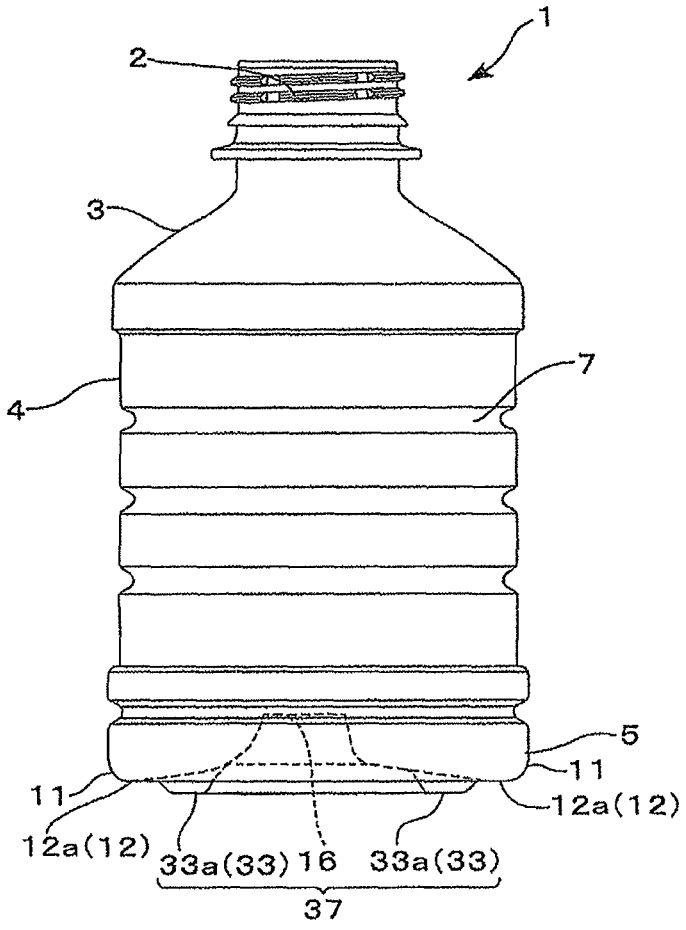
FIG. 9 is a front view of the bottle in the third embodiment of this invention.
Figure 10:
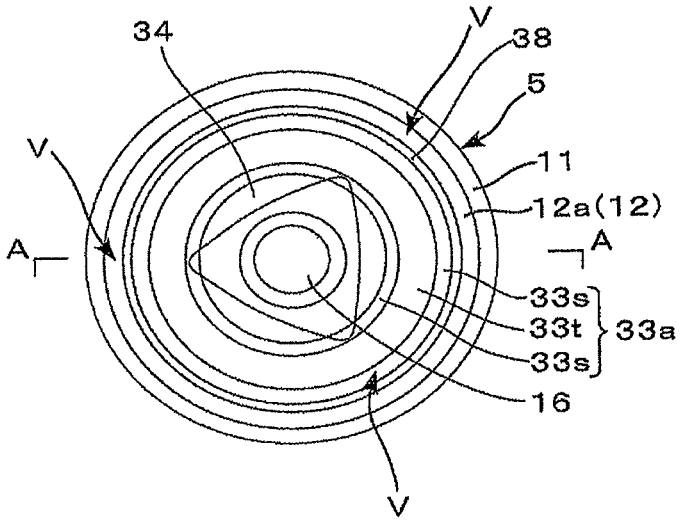
FIG. 10 is a bottom view of the bottle of FIG. 9.
Figure 11:
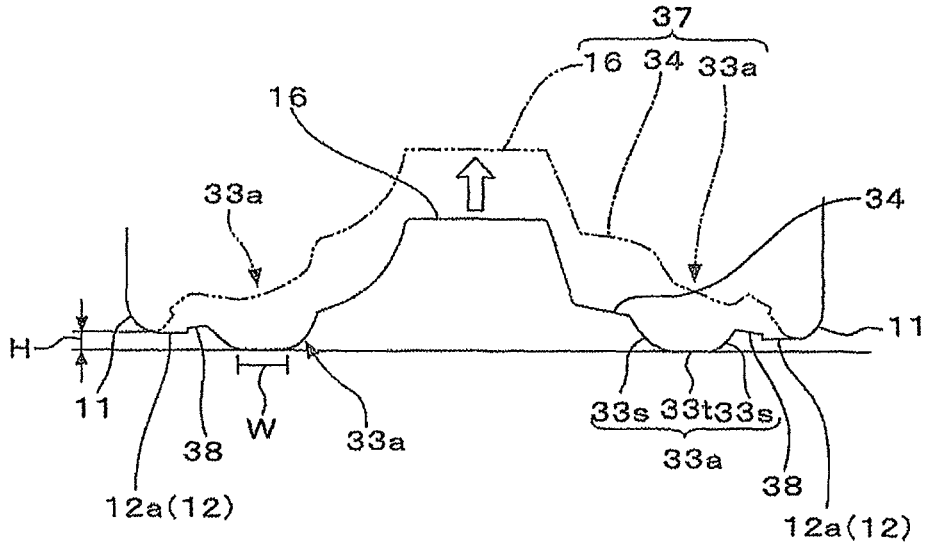
FIG. 11 is a vertical section taken along line A-A in FIG. 10 and is an enlarged view near the bottom of the bottle of FIG. 9.

FIGS. 9 to 11 show the synthetic resin bottle in the third embodiment of this invention. FIG. 9 is a front view, FIG. 10 is a bottom view, and FIG. 11 is a vertical section taken along line A-A in FIG. 10, showing the bottom 5 and its vicinity. This bottle 1 comprises a neck 2, a shoulder 3, a cylindrical body 4, and a bottom 5, and is a biaxially stretched, blow-molded PET resin bottle having a capacity of 280 ml.

Three peripheral groove ribs 7 are disposed in the wall of the body 4 as a means of increasing surface rigidity and buckling strength to give the body 4 high shape retainability although the means of increasing surface rigidity and buckling strength is obviously not limited to the peripheral groove ribs 7. The bottom 5 is connected to the lower end of this body 4 by way of a heel wall portion 11 having a curved surface. The peripheral foot 12 of the bottom 5 has a circular flat foot portion 12*a*. A circular bottom ridge 33*a* is disposed on the inner side of the peripheral foot 12, and is formed by projecting the bottom plate downward from the circular flat foot portion 12*a* to serve as the bottom ridge 33 which performs the function as a ground contact portion. A central concave portion 16 is formed in the center by using an edge of an inner sidewall of the circular bottom ridge 33*a*, and concaving the bottom plate upward and inward by way of a step 34. The stepped portions 34 narrow in an upward direction and are disposed between the edge of the inner sidewall of the bottom ridge and a lower end of the central concave portion. A groove-like recess 38 is disposed on the boundary between the inner edge of the peripheral foot 12 and the outer edge of the bottom ridge 33. This recess is formed by depressing the bottom plate upward and inward in a stepped manner.

The circular bottom ridge 33*a* comprises a pair of inclined sidewalls 33*s* and a flat ridge portion 33*t* at the ridge bottom, and has a cross-section in a trapezoidal shape (or a U-letter shape). In this embodiment, the projecting height H from the circular flat foot portion 12*a* is set at 2 mm, and the width W of the flat ridge portion 33*t* is set at 6 mm (See FIG. 11). In its plane bottom view, the central concave portion 16 has a circular shape in and near the central part, but gradually changes into a regular triangular shape at the bottom. If the bottom ridge 33 is used as the ground contact portion as described above, there is concern on a lower level of self-standing capability as compared to that of the peripheral foot 12. It is important here to set the projecting height in a predetermined range, giving consideration to the position of the bottom ridge 33. Even if the bottle comes close to fall, the circular flat foot portion 12*a* of the peripheral foot 12 abuts on the ground to support the bottle. Thus, the bottle keeps standing alone with no further inclination.

According to the above-described feature, the bottle 1 retains its cylindrical shape, partly with the help of the peripheral groove ribs 7, when the bottle 1 of this embodiment has been passed through a hot filling process, then cooled and placed under a reduced pressure condition. In this state, as shown in FIG. 11 by a two-dot chain line, the circular bottom ridge 33*a* in the trapezoidal cross-sectional shape deforms in an extending manner, and the deformable sunken portion 37 ranging from the circular bottom ridge 33*a* to the central concave portion 16 draws upward and sinks further (See the direction of an outline arrow in FIG. 11).

In the state in which the deformable sunken portion 37 draws upward to a higher sunken position due to the depressurization described above, the circular flat foot portion 12*a* performs the function as the ground contact portion instead of the circular bottom ridge 33*a*. Therefore, even under the reduced pressure condition, the bottle 1 retains its self-standing capability. A groove-like recess 38 is disposed on the border between the inner edge of the circular flat foot portion 12*a* and the outer edge of the bottom ridge 33. With this groove-like recess 38 as the starting point, it is possible for the deformable sunken portion 37 to smoothly draw upward to a higher sunken position under the reduced pressure condition. In addition, the circular flat foot portion 12*a* of the peripheral foot 12 can be prevented from distorted deformation, and thus, the peripheral foot 12 is further stabilized to perform the function as the ground contact portion.

A total of 6 types of bottles were prepared, and tests of measuring vacuum-absorbing capacities were conducted to make sure of the action and effect of the bottle of this invention. There were bottles having a width W of 6 mm for the flat ridge portion 33*t* of the circular bottom ridge portion 33*a* and a projecting height of 2 mm; the bottles having a corresponding width H of 6 mm and projecting heights of 1 and 0 mm; and the bottles having a projecting height H of 2 mm and widths H of 5, 7, and 8 mm.

(1) The six types of bottles were as follows:

The bottle of the 3rd embodiment. W: 6 mm; and H: 2 mm

The bottle of the 4th embodiment. W: 6 mm; and H: 1 mm

The bottle of the 5th embodiment. W: 5 mm; and H: 2 mm

The bottle of the 6th embodiment. W: 7 mm: and H: 2 mm

The bottle of the 7th embodiment. W: 8 mm; and H: 2 mm

The bottle of a comparative example. W: 6 mm; and H: 0 mm (This bottle corresponds to a conventional bottle having no bottom ridge 33 projecting from the surface of the bottom 5.)

(2) The tests of measuring vacuum-absorbing capacities

The test bottles were filled with water to the full. A buret having a rubber stopper was fitted to the neck of each bottle. A vacuum pump was operated to reduce internal pressure at a speed of 0.4 kPa/sec measured with a manometer. The buret readings were taken at the time when the bottle showed abnormal deformation such as a local dent or buckling deformation. The difference in buret readings before and after the test was used to calculate the vacuum-absorbing capacity.

Figure 12:
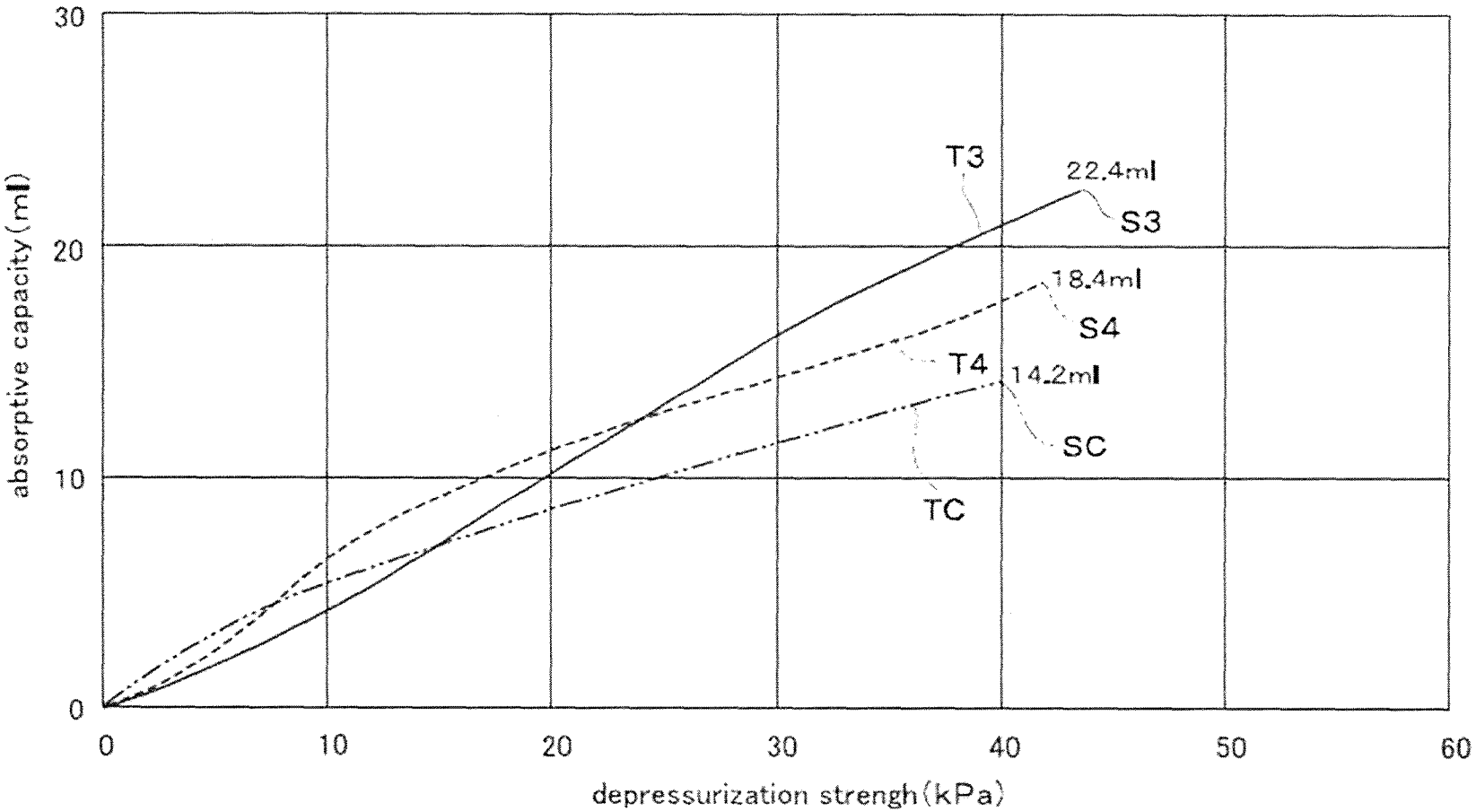
FIG. 12 is a graph showing the results of a test for the measurements of vacuum-absorbing capacities.

FIG. 12 is a graph showing the results of the tests for measuring the vacuum-absorbing capacities, using bottles of the 3rd embodiment, the 4th embodiment, and the comparative example having a regular width W of 6 mm for the flat ridge portion 33*t* and varying projecting heights of 2 mm, 1 mm, and 0 mm, respectively. The graph was depicted with the depressurization strength (kPa) as the horizontal axis and the absorption capacity (ml) as the vertical axis. In the graph, the T3 line shows the results from the 3rd embodiment; the T4 line, from the 4th embodiment, and TC, from the bottle of the comparative example.

For all three types of bottles, abnormal deformation was that the bottom plate bends into an inverted V shape to form a foldline in the radial direction at either one of the three angle positions of the circular flat foot portion 12*a* shown by arrowed V letters in FIG. 10 (corresponding to the central angle positions where there are three apexes of a regular triangle). At abnormally deformed points shown as S3, S4, and SC in FIG. 12, the test results gave the following vacuum absorbing capacities:

The bottle of the 3rd embodiment: 22.4 ml

The bottle of the 4th embodiment: 18.4 ml

The bottle of the comparative example: 14.2 ml

These values indicate that the bottle of this invention has a preferable action-and-effect obtained by putting the circular bottom ridge 33*a* on the bottom.

Figure 13:
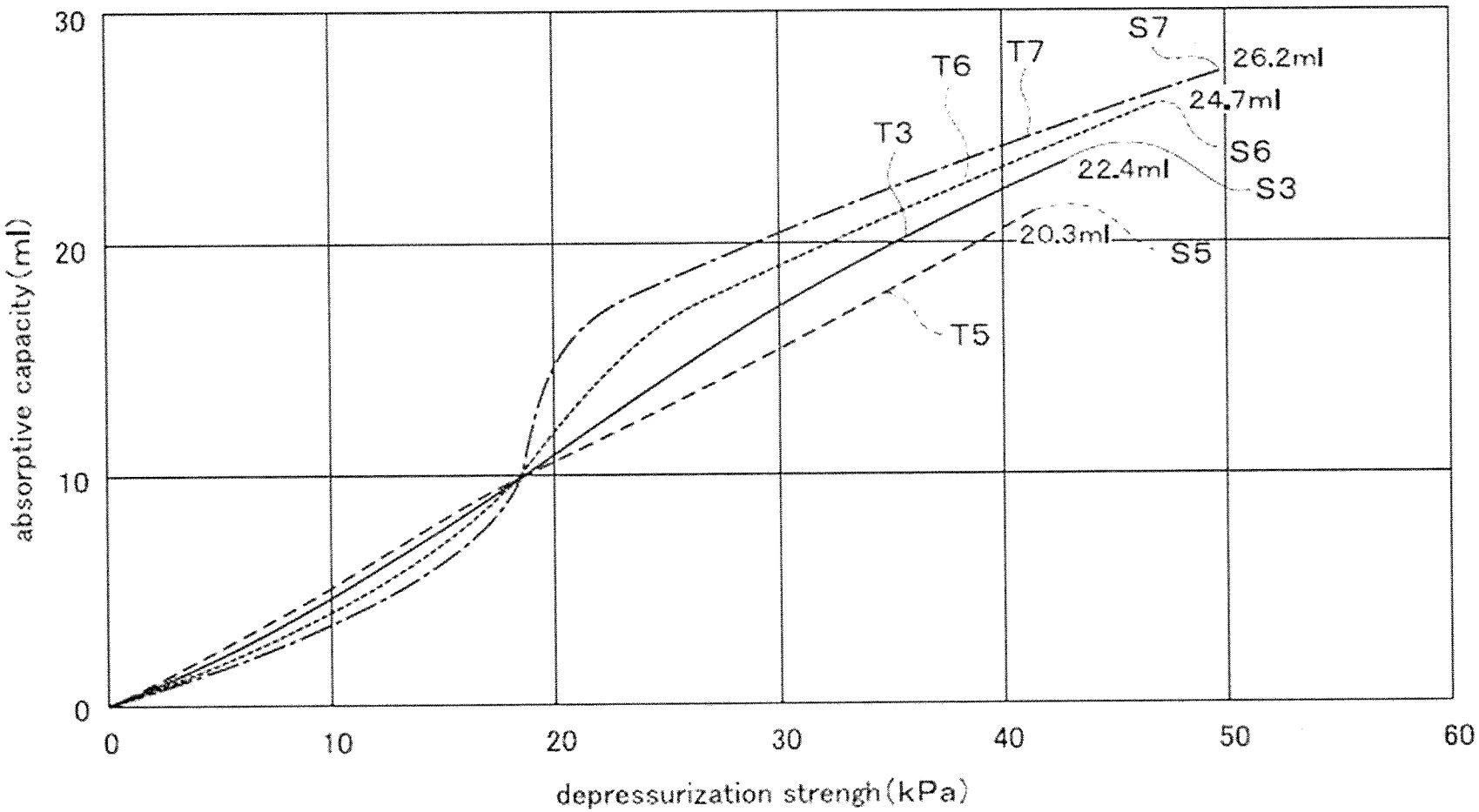
FIG. 13 is a graph showing other results of a test for the measurements of vacuum-absorbing capacities.

FIG. 13 is also a graph similar to FIG. 12, showing the results of tests for measuring the vacuum-absorbing capacities, using bottles of the 3rd, 5th, 6th, and 7th embodiments having the same projecting height H of 2 mm and varying widths W of the flat ridge portion of 6 mm, 5 mm, 7 mm, and 8 mm, respectively. In FIG. 13, T3 is a result from the 3rd embodiment; T5, the result from the 4th embodiment, T6, the result from the 6th embodiment, and T7, the result from the 7th embodiment.

Likewise for all four types of bottles shown in FIG. 13, as in the three types of bottles shown in FIG. 12, the abnormal deformation was that the bottom plate bends into an inverted V shape to form a foldline in the radial direction at either one of the three angle positions of the circular flat foot portion 12*a* shown by arrowed V letters in FIG. 10 (corresponding to the central angle positions where there are three apexes of a regular triangle). At abnormally deformed points shown as S3, S5, S6 and S7 in FIG. 13, the test results gave the following vacuum absorbing capacities:

The bottle of the 3rd embodiment: 22.4 ml

The bottle of the 5th embodiment: 20.3 ml

The bottle of the 6th embodiment: 24.7 ml

The bottle of the 7th embodiment: 26.2 ml

From the test results shown in FIG. 13, it is found that in a region having a highly reduced pressure (the region of 20 kPa or more in FIG. 13), the larger the width of the flat ridge portion 33*t* ranging from 5 to 8 mm, the larger vacuum-absorbing capacity would result under the same reduced pressure level, which means that the deformable sunken portion 37 is easier to draw upward and that the bottles have larger vacuum-absorbing capacities at the points of abnormal deformation and perform the larger vacuum-absorbing function. Too large a width W may affect the shapes of the circular flat foot portion 12*a*, the step 34, and the central concave portion 16, but the width can be set arbitrarily, giving consideration to the bottle size and the ratio of the circular bottom ridge 33*a* to the projecting height H, and relying on calculations and test results regarding the way of deformation.

Figure 14:
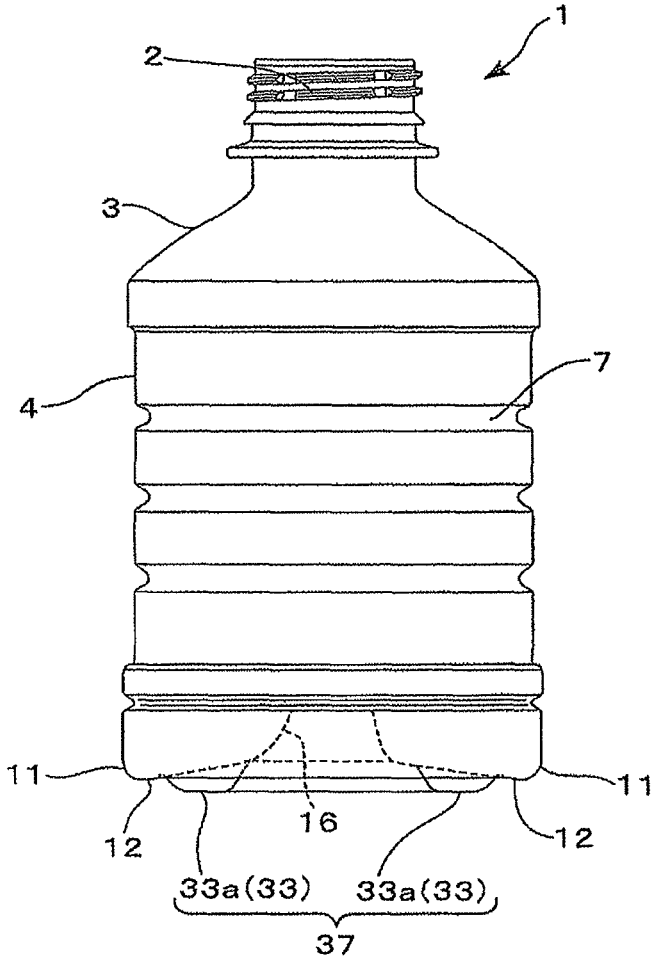
FIG. 14 is a front view of the bottle in the eighth embodiment of this invention.
Figure 15:
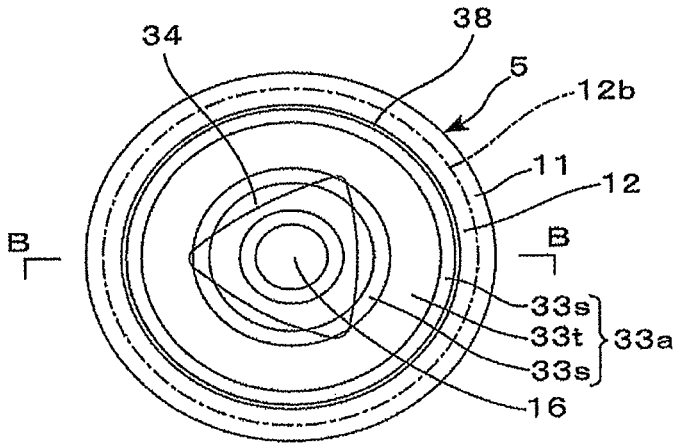
FIG. 15 is a bottom view of the bottle of FIG. 14
Figure 16:
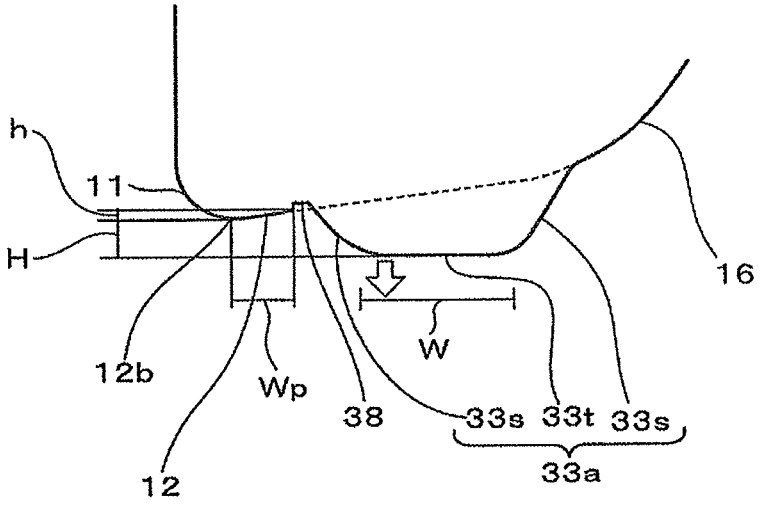
FIG. 16(*a*) is a vertical section of the bottle of FIG. 14 taken along line B-B in FIG. 15 and is an enlarged view near the peripheral foot and the bottom ridge.
Figure 16:
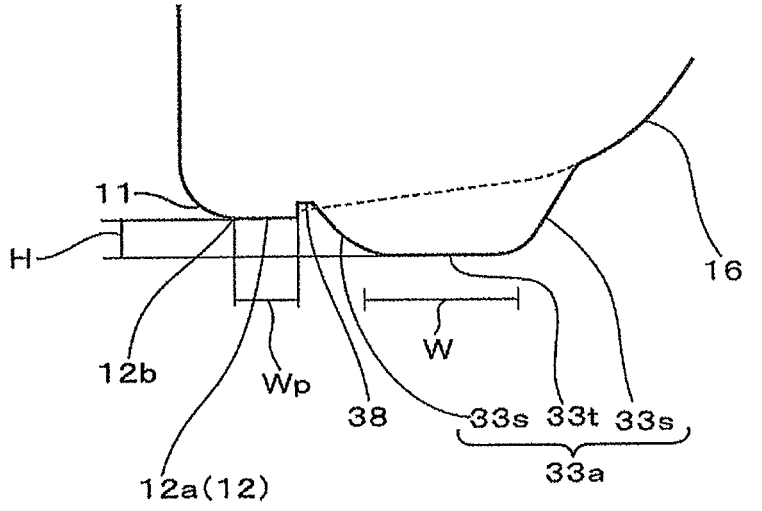

FIGS. 14 to 16 shows the bottle in the eighth embodiment of this invention, in which FIG. 14 is a front view, and FIG. 15 is a bottom view. The bottle 1 has an overall shape roughly identical with the bottle shown in FIGS. 9 and 10. The bottom ridge 33 has a projecting height H of 2 mm and a width W of 8 mm, the same dimensions as those of the bottle of the 7th embodiment.

FIG. 16(*a*) and FIG. 16(*b*) are enlarged vertical sections of important parts in the vicinity of the peripheral foot 12 and the bottom ridge 33 of the bottles of the 8th and 7th embodiments, respectively. The bottom 5 of both bottles has such a shape that the bottom ridge 33 is connected to the heel wall portion 11 by way of the peripheral foot 12. A groove-like recess 38 is formed by denting the bottom plate inward in a stepped manner and is disposed on the boundary between the inner edge of the peripheral foot 12 and the outer edge of the bottom ridge 33.

For both bottles, a width Wp of the peripheral foot 12 is set at 3 mm. In the bottle of the 7th embodiment, the peripheral foot 12 has a horizontal circular flat foot portion 12*a*. On the other hand, in the bottle of the 8th embodiment, the peripheral foot 12 is characterized by a slope that extends obliquely upward, as shown in FIG. 16(*a*). If the gradient of this slope is expressed as a difference in height (h) between a lowermost end 12*b* and a sloped inner edge of the peripheral foot 12 (See FIG. 16(*a*)), this difference in height (h) is set at 0.5 mm.

Right after the bottle filled with contents at a high temperature has been sealed with a cap during the hot filling process, what is called the bottom sinking phenomenon may develop because the synthetic resin of the bottle softens and also because the bottle inside is put under a pressurized condition. The bottom plate of the bottle deforms downward into a swelled state (in the direction indicated by an outlined arrow in FIG. 16(*a*)). The higher the temperature at which the bottle is filled with the contents, and thinner the wall of the bottle is, the larger this bottom sinking phenomenon grows. If the bottom sinking grows to some large extent, the deformable sunken portion 37 may draw upward unevenly and disproportionately when the pressure inside the bottle has turned low. As a result, the vacuum-absorbing function is not performed sufficiently, but local deformation takes place at the peripheral foot, and the bottle has its self-standing capability impaired.

The bottle of the 8th embodiment is intended to outstand the hot filling at a higher temperature than in ordinary operations and to cope with a trend toward further thinning bottle wall. As shown in FIG. 16(*a*), the peripheral foot 12 is inclined so as to control the above-described bottom sinking phenomenon effectively.

If the peripheral foot 12 has too steep a slope, the bottom sinking can be inhibited fully, but it also becomes difficult for the deformable sunken portion 37 to draw upward at the time of the reduced pressure condition, and the vacuum-absorbing function is not performed sufficiently. Therefore, the width Wp of the peripheral foot 12 is set at 2 to 4 mm (or 3 mm in the bottle of the 8th embodiment), and the difference in height (h) is set at 0.2 to 0.8 mm (or 0.5 mm in the 8th embodiment), giving consideration to the function of the deformable sunken portion 37 as the ground contact portion at the time of a decrease in pressure. Within these ranges, the bottle can perform the vacuum-absorbing function sufficiently while controlling the bottom sinking effectively.

A groove-like recess 38 can be laid out, if necessary. Its width and groove depth is arbitrarily determined. Whether the peripheral foot 12 is disposed in a horizontal flat shape or in a slope, and if it is a slope, how much gradient the slope should have, will be determined arbitrarily, while giving consideration to the temperature at which bottles are filled with the contents, and to the extent of wall thinning.

The features and action-and-effects of this invention have been described with respect to preferred embodiments. However, preferred embodiments of this invention are not limited to those described above. For example, FIGS. 17(*a*), 17(*b*), and 17(*c*) show other examples of the bottom 5 of the bottle 1 in the 3rd embodiment shown in FIGS. 9 and 10. As shown, the bottom 5 has a few variations, depending on the purpose of use. The bottle of the 3rd embodiment gives the central concave portion 16 an anisotropic shape having a plane cross-section of a regular triangle. However, this plane cross-section may be circular as shown in FIG. 17(*a*), or the step 34 may be polygonal as shown in FIG. 17(*b*).

The width and projecting height of the bottom ridge 33 can be determined arbitrarily, giving consideration to bottle size, wall thickness, and self-standing capability of the bottle and relying on calculations and test results regarding the way of deformation including easiness of bottom plate to deform. The bottom ridge 33 is not limited to a circular bottom ridge

Figure 17:
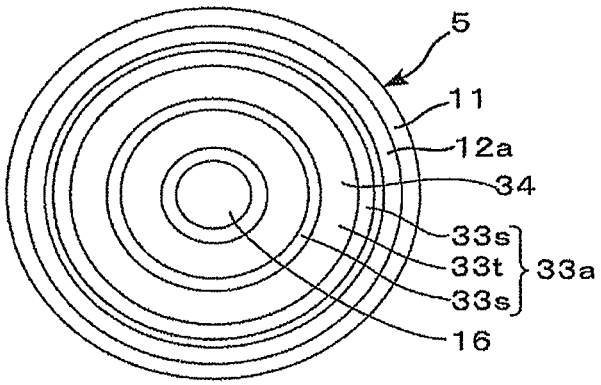
FIGS. 17(*a*), 17(*b*), and 17(*c*) are bottom views showing other examples of bottom shape.
Figure 17:
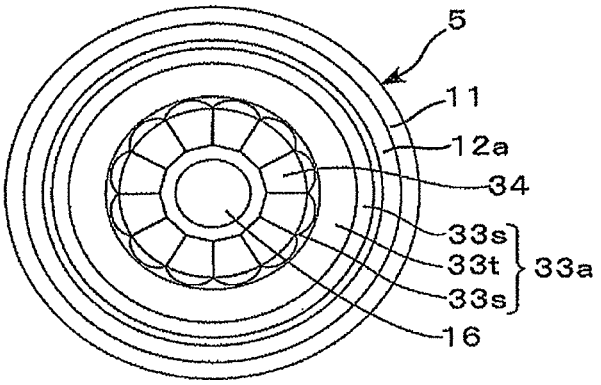
Figure 17:
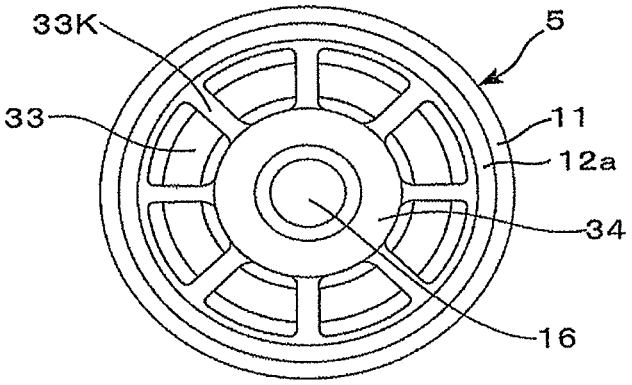
Figure 18:
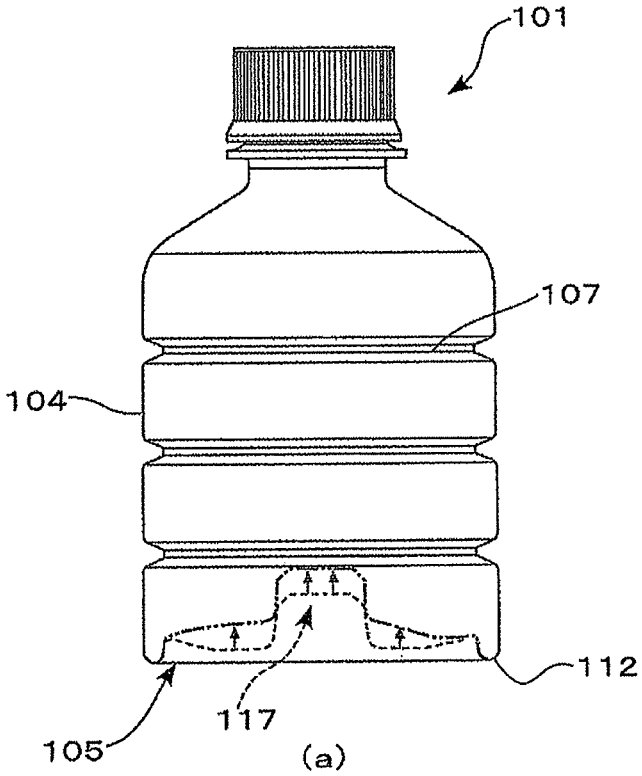
FIG. 18(*a*) is a front view.
Figure 18:
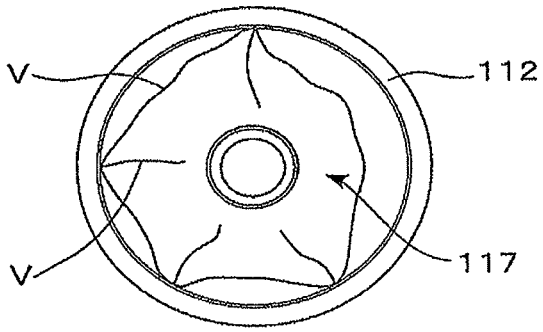

33*a* in the above embodiments, but as shown in FIG. 17(*c*), it may be characterized by multiple segments (8 in FIG. 17(*c*)) of the bottom ridge 33. These segments are disposed in a circle but are cut by missing portions 33K disposed alternately.

INDUSTRIAL APPLICABILITY

The synthetic resin bottle of this invention has no vacuum-absorbing panels on the body. Instead, the bottom performs a sufficient vacuum-absorbing function as the bottom draws upward. The bottle has high self-standing capability, and the bottom can fully recover from the upward drawing deformation. Thus, the bottle of this invention is expected to find further uses in a vast field of bottles requiring hot filling operations

DESCRIPTION OF REFERENCE SIGNS

1. Bottle
2. Neck
3. Shoulder
4. Body
5. Bottom
7. Peripheral groove rib
11. Heel wall portion
12. Peripheral foot
12*a*. Circular flat foot portion
12*b*. Lowermost end (of the peripheral foot)
12*g*. Ground contact portion
13. Reversible wall portion
14. Circular rib wall portion
14*a*. Flat ring portion
14*b*. Circular groove
14*c*. Circular step portion
15. Inner peripheral wall portion
16. Central concave portion
17. Sunken bottom portion
19. Radial rib
21. Cap
33. Bottom ridge
33*a*. Circular bottom ridge
33*k*. Missing portion
33*t*. Flat ridge portion
33*s*. Inclined sidewall
34. Step portion
37. Deformable sunken portion
38. Groove-like recess
101. Bottle
102. Neck
103. Shoulder
104. Body
107. Peripheral groove rib
111. Heel wall portion
112. Peripheral foot
112*g*. Ground contact portion
113. Reversible wall portion
115. Inner peripheral wall portion
116. Central concave portion
117. Sunken bottom portion
V (Vr, Vp). Foldline
H. Projecting height
W. Width (of bottom ridge)
Wp. Width (of peripheral foot)
Lf. Liquid level

The invention claimed is:

1. A biaxially stretched, blow molded synthetic resin bottle with a bottom configured for absorbing depressurization caused by cooling the bottle after it has been hot-filled with a content fluid, said bottom comprising:

a peripheral foot disposed along an outermost border of a bottom plate of the bottom, and a deformable sunken portion having:

a bottom ridge having a trapezoidal shape or a U-letter shape as viewed in vertical cross-section disposed inward from the peripheral foot and formed by projecting a portion of the bottom plate downward to a position lower than a level of the peripheral foot so that the bottom ridge is configured to function as a ground contact portion, a central concave portion formed at a center of the bottom plate by concaving the bottom plate upward and inward, starting from an edge of an inner sidewall of the bottom ridge, and stepped portions that narrow in an upward direction and are disposed between the edge of the inner sidewall of the bottom ridge and a lower end of the central concave portion, wherein:

the deformable sunken portion is configured to draw upward to a position higher than the level of the peripheral foot to absorb reduced pressure, while starting from an inner edge of the peripheral foot and maintaining each of the shapes of the bottom ridge, the central concave portion and the stepped portions as viewed in vertical cross-section, and in this state, only the peripheral foot instead of the bottom ridge is configured to perform the function as the ground contact portion.

2. The synthetic resin bottle according to claim 1, wherein the bottom ridge is an annular bottom ridge.

3. The synthetic resin bottle according to claim 1, wherein the central concave portion has a shape in which its horizontal cross-section changes from a circular shape at and near the central flat area to a regular triangular shape at a base of the central concave portion.

4. The synthetic resin bottle according to claim 1, wherein a groove-like recess is disposed on the boundary between an inner edge of the peripheral foot and an outer edge of the bottom ridge, the recess being formed by recessing the bottom plate inward in a stepped manner.

5. The synthetic resin bottle according to claim 1, wherein a plurality of peripheral groove ribs is formed around a cylindrical body.

* * * * *